US007818842B2

(12) United States Patent
Marciano

(10) Patent No.: US 7,818,842 B2
(45) Date of Patent: Oct. 26, 2010

(54) FOLDABLE MATTRESS WITH INTEGRAL CARRYING POUCH

(75) Inventor: Ralph C. Marciano, Riverside, RI (US)

(73) Assignee: Aqua-Leisure Industries, Inc., Avon, MA (US)

( * ) Notice: Subject to any disclaimer, the term of this patent is extended or adjusted under 35 U.S.C. 154(b) by 0 days.

(21) Appl. No.: 12/429,333

(22) Filed: Apr. 24, 2009

(65) Prior Publication Data

US 2010/0186165 A1 Jul. 29, 2010

Related U.S. Application Data

(60) Provisional application No. 61/147,849, filed on Jan. 28, 2009.

(51) Int. Cl.
*A47C 27/08* (2006.01)
*B63B 7/08* (2006.01)
*B63B 35/613* (2006.01)

(52) U.S. Cl. ..... 5/694; 5/706; 5/655.3; 5/654; 441/131; 441/40

(58) Field of Classification Search ..... 5/694, 5/639, 706, 644, 654, 655.3, 485, 413 R, 5/413 AM, 417, 419, 420; 441/131, 40
See application file for complete search history.

(56) References Cited

U.S. PATENT DOCUMENTS 1,738,411 A * 12/1929 Welch ..... 5/655
1,960,474 A * 5/1934 Browne ..... 441/129
2,443,440 A * 6/1948 Alvarez ..... 4/506
2,689,812 A * 9/1954 Mollica et al. ..... 156/281
2,718,014 A * 9/1955 Mizrach et al. ..... 4/506
3,021,536 A * 2/1962 Haggerty ..... 441/40
3,080,584 A * 3/1963 Brown ..... 441/67
3,089,153 A * 5/1963 Bosc ..... 5/710
3,513,489 A * 5/1970 Miller et al. ..... 5/98.1
3,619,825 A * 11/1971 Taub et al. ..... 5/94
3,628,206 A * 12/1971 Mecham ..... 280/18.1
3,631,544 A * 1/1972 Tytel ..... 4/506
3,633,227 A * 1/1972 Tegeler ..... 5/413 R
3,653,084 A * 4/1972 Hartman ..... 441/40
3,740,095 A * 6/1973 Nail ..... 297/452.41
3,742,994 A * 7/1973 Pensak ..... 383/3
3,761,975 A * 10/1973 Personett ..... 5/655
3,816,858 A * 6/1974 Martin ..... 4/515
3,871,042 A * 3/1975 Farmer ..... 114/346
4,104,750 A * 8/1978 Kelter et al. ..... 5/93.1
4,583,253 A * 4/1986 Hall ..... 5/94
4,651,360 A * 3/1987 Wang ..... 4/506
4,815,153 A * 3/1989 Bleser et al. ..... 5/98.1
4,862,533 A * 9/1989 Adams, III ..... 5/413 R
4,905,332 A * 3/1990 Wang ..... 5/655.3
4,964,183 A * 10/1990 LaForce, Jr. ..... 5/421
5,003,653 A * 4/1991 Mar ..... 5/654

(Continued)

*Primary Examiner*—Robert G Santos
(74) *Attorney, Agent, or Firm*—Lando & Anastasi, LLP

(57) ABSTRACT

A foldable mattress having an integral carrying pouch into which the mattress may be folded when not in use. Preferably, the mattress is at least partly inflatable so as to be floatable, and may have a mesh central portion surrounded by an inflatable portion. An inflatable pillow or headrest that is either fixed in place or detachable may be included. The pouch itself is preferably made, at least in part, of nylon mesh material.

5 Claims, 4 Drawing Sheets

U.S. PATENT DOCUMENTS 5,101,823 A * 4/1992 Smith ..... 607/81
5,219,307 A * 6/1993 Morrison ..... 441/38
5,279,237 A * 1/1994 Alivizatos ..... 112/475.05
5,279,510 A * 1/1994 Remy ..... 441/67
5,291,623 A * 3/1994 Artz ..... 5/93.1
5,341,530 A * 8/1994 Ward ..... 5/93.1
5,345,622 A * 9/1994 Plone ..... 4/588
5,386,602 A * 2/1995 Krenzler ..... 5/413 R
5,476,404 A * 12/1995 Price ..... 441/131
5,561,876 A * 10/1996 Petruzella ..... 5/724
5,575,738 A * 11/1996 Millington et al. ..... 482/35
5,628,275 A * 5/1997 Casey ..... 119/28.5
5,640,725 A * 6/1997 Ando et al. ..... 5/413 AM
5,699,569 A * 12/1997 Schwarz-Zohrer ..... 5/655
5,729,840 A * 3/1998 Wu ..... 4/588
5,740,565 A * 4/1998 McDade ..... 5/413 AM
5,813,066 A * 9/1998 Gebhard et al. ..... 5/655
5,813,946 A * 9/1998 Lin et al. ..... 482/27
5,855,033 A * 1/1999 Frissen et al. ..... 5/706
5,930,854 A * 8/1999 O'Neill et al. ..... 5/655
6,076,214 A * 6/2000 Klimenko ..... 5/710
6,485,344 B2 * 11/2002 Arias ..... 441/131
6,505,366 B1 * 1/2003 Lied ..... 5/655
6,508,682 B1 * 1/2003 Clark ..... 441/40
6,588,028 B1 * 7/2003 Wu ..... 4/506
6,675,414 B2 * 1/2004 Lamke ..... 5/413 AM
6,704,953 B2 * 3/2004 Fishman ..... 5/413 R
6,721,974 B1 * 4/2004 Wilkinson ..... 5/425
6,785,921 B1 * 9/2004 Conforti ..... 5/655
6,799,338 B1 * 10/2004 Hsia ..... 5/93.1
6,848,128 B2 * 2/2005 Verbovszky et al. ..... 5/93.1
6,964,073 B1 * 11/2005 Curry ..... 5/626
7,059,000 B2 * 6/2006 Verbovszky ..... 5/655
7,062,807 B2 * 6/2006 Conforti ..... 5/655
7,097,524 B2 * 8/2006 Arias ..... 441/131
7,134,930 B2 * 11/2006 Arias ..... 441/131
7,147,528 B2 * 12/2006 Arias ..... 441/131
7,335,080 B2 * 2/2008 Arias ..... 441/131
7,357,688 B2 * 4/2008 Ferrara ..... 441/35
7,418,748 B2 * 9/2008 Lamke ..... 5/413 AM
7,500,893 B2 * 3/2009 Arias ..... 441/131
D595,384 S * 6/2009 Marciano ..... D21/803
7,578,014 B1 * 8/2009 Rodriguez ..... 5/636
D599,428 S * 9/2009 Marciano ..... D21/803
2003/0068940 A1 * 4/2003 Arias ..... 441/131
2005/0005361 A1 * 1/2005 Conforti ..... 5/655

* cited by examiner

FOLDABLE MATTRESS WITH INTEGRAL CARRYING POUCH

BACKGROUND

This invention relates to a mattress, and particularly to a foldable mattress with an integral carrying pouch into which the mattress may be folded when not in use. Preferably, the mattress is at least partly inflatable so as to be floatable, and may have a mesh central portion surrounded by an inflatable portion. An inflatable pillow or headrest that is either fixed in place or detachable may be included. The pouch itself is preferably made, at least in part, of nylon mesh material.

SUMMARY

Inflatable mattresses are widely popular for lounging at the beach or pool. When deflated, they are often folded to conserve space, and take the form of a bulky, cumbersome bundle that may or may not stay folded. As a consequence, these folded mattresses are not always easy to carry or store away. The instant invention is directed to a mattress that has an integral pouch for receiving the folded mattress, providing a ready and convenient way to store and carry the deflated mattress.

BRIEF DESCRIPTION OF THE DRAWINGS

A mattress in accordance with the instant invention is shown in the attached drawings.

DETAILED DESCRIPTION

Figure 1:
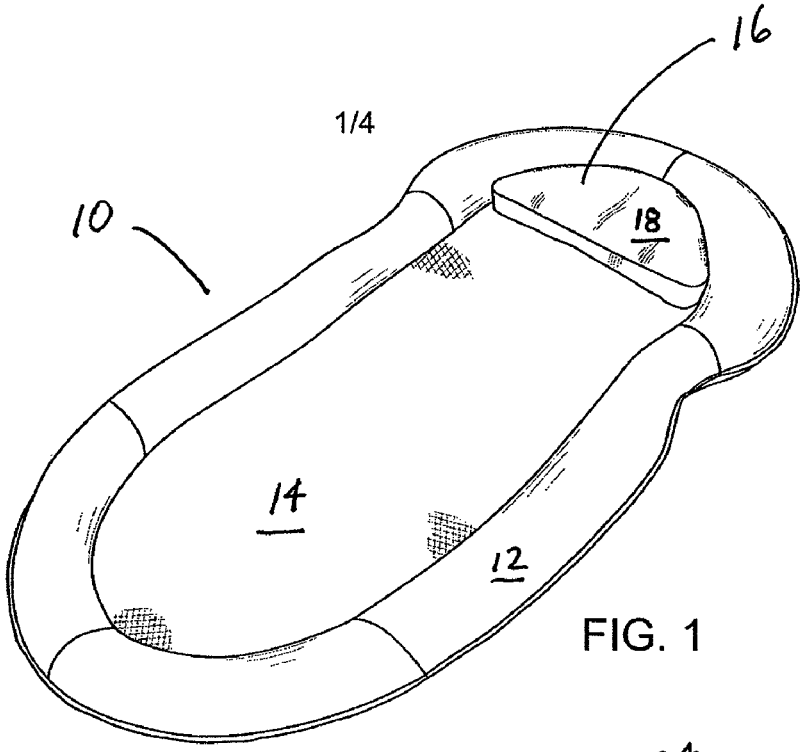
FIG. 1 is a perspective view of the top side of a foldable mattress according to one embodiment of the instant invention.

Referring to FIG. 1, foldable mattress 10 has a perimeter portion or rim 12 that is inflatable and is generally circular in cross-section. The over-all shape of perimeter portion 12 somewhat resembles a figure "8." Attached to the inner edge of perimeter portion 12 are a body portion 14 preferably comprised of nylon mesh, and a head portion 16 that receives a separate, detachable, inflatable pillow 18. Body portion 14 and head portion 16 are joined at edge 20 (see FIG. 3).

Figure 2:
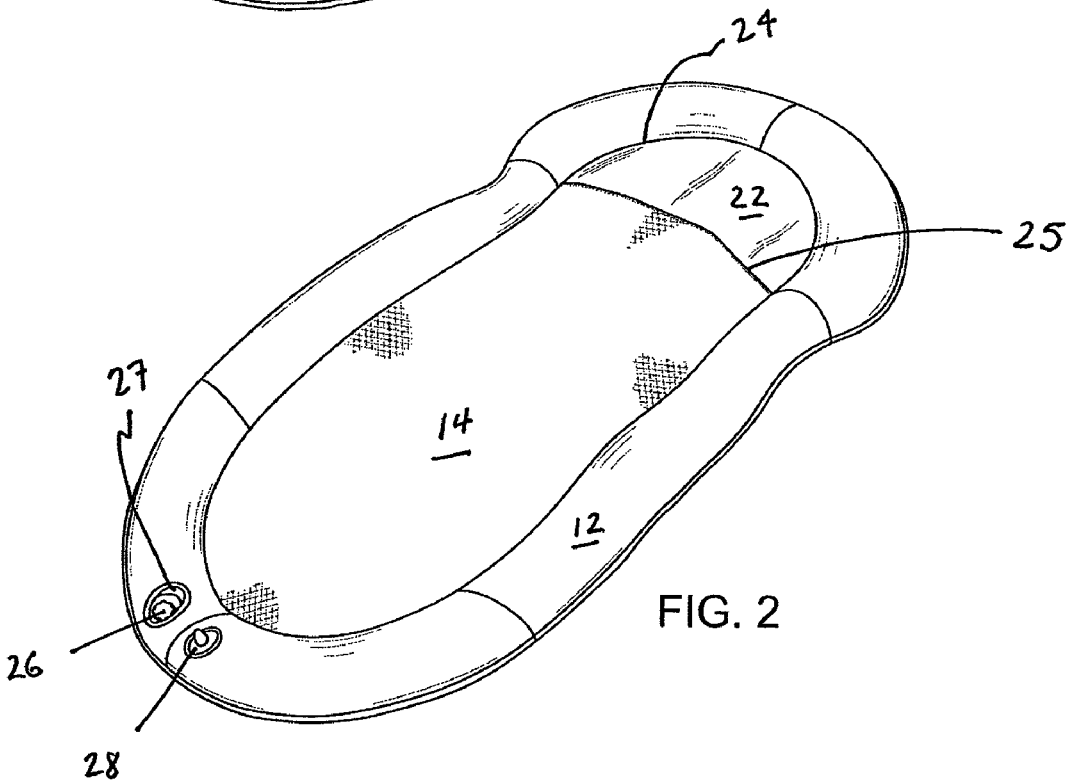
FIG. 2 is a perspective view of the underside of the foldable mattress of FIG. 1, showing the integral carrying pouch.

The underside of foldable mattress 10 is shown in FIG. 2. A pouch portion 22 is partially curved in shape and is attached along its curved edge 24 to the inner edge of perimeter portion 12, and in a location opposite or under detachable pillow 18.

Edge 25 of pouch portion 22 is unattached, providing an opening for access to pouch portion 22. Perimeter portion 12 may be inflated via large inflation valve 26 and/or small inflation valve 28, either alone or simultaneously, Perimeter portion 12 is shown in its inflated state in FIG. 1, as is pillow 18. When perimeter portion 12 and pillow 18 are deflated, they may be folded and inserted, along with body portion 14, into a pocket formed by pouch portion 22, as further explained below.

Figure 3:
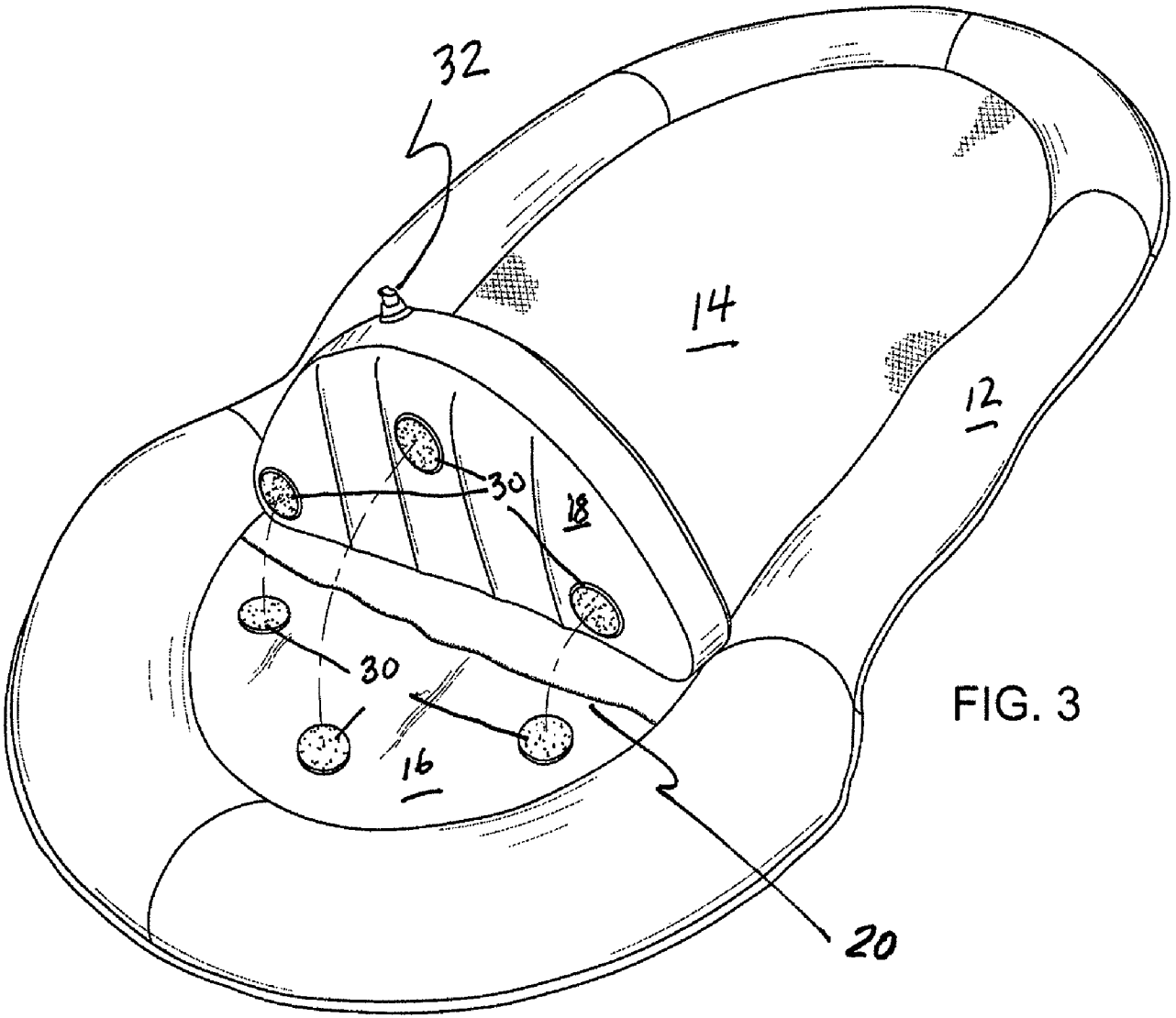
FIG. 3 is a perspective view of the top side of the mattress of FIG. 1, showing the detachable pillow detached from the mattress.

FIG. 3 depicts the pillow 18 detached from head portion 16 and turned upward, so that one may see hook-and-loop material 30 on the pillow 18 and on head portion 16 that allows pillow 18 to be removably attached to the mattress. The pillow 18 is preferably inflatable—e.g., via a valve 32—and when deflated may be tucked into the pocket formed by pouch portion 22, either while attached to head portion 16, or separately.

Figure 4A:
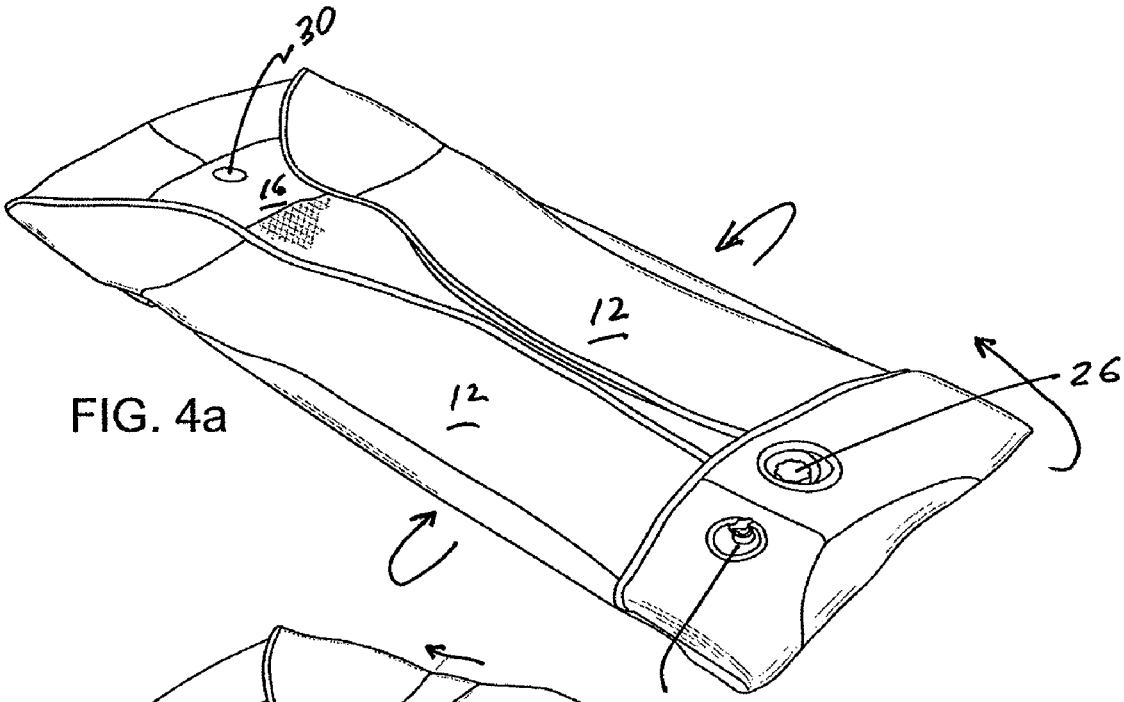
FIG. 4*a* is a top view of the deflated mattress, with pillow removed, and partially folded for insertion into the integral pouch.

FIGS. 4*a*-4*d* show one way to fold the deflated mattress 10 into the pocket formed by pouch portion 22. In FIG. 4*a*, the top side of the mattress is seen with pillow 18 removed and the mattress partly folded at the other end. First, the long sides of the mattress are folded toward the longitudinal center line, and the foot end of the mattress is then folded toward the head portion.

Figure 4B:
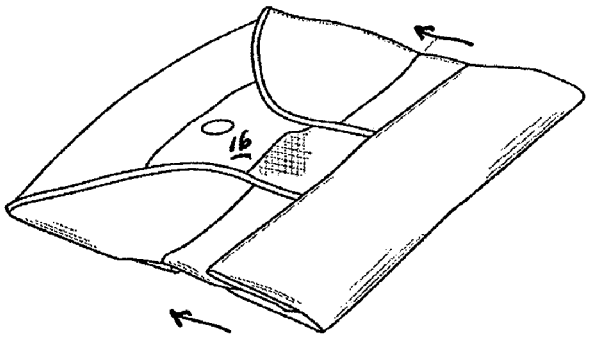
FIG. 4*b* depicts the deflated mattress further folded.
Figure 4C:
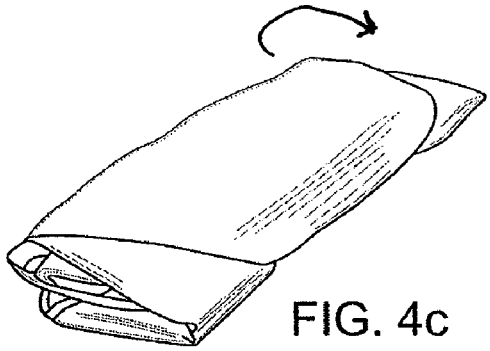
FIG. 4*c* shows the upper end of the mattress of FIG. 4*b* folded back over.
Figure 4D:
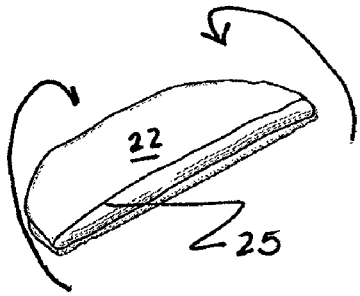
FIG. 4*d* depicts the pouch portion pulled out from the bottom of the mattress up and over the remainder of the mattress so that the folded mattress is captured within the pouch.

In FIG. 4*b*, the mattress has been further folded from the foot end toward the head portion. FIG. 4*c* shows the mattress after further folding, and then with the upper or head end folded back toward the foot end. FIG. 4*d* shows the mattress after edge 25 and pouch portion 22 have been pulled over from the underside of the mattress to envelop the entire folded mattress in a pocket formed between pouch portion 22 and the underside of the folded mattress.

Figure 5:
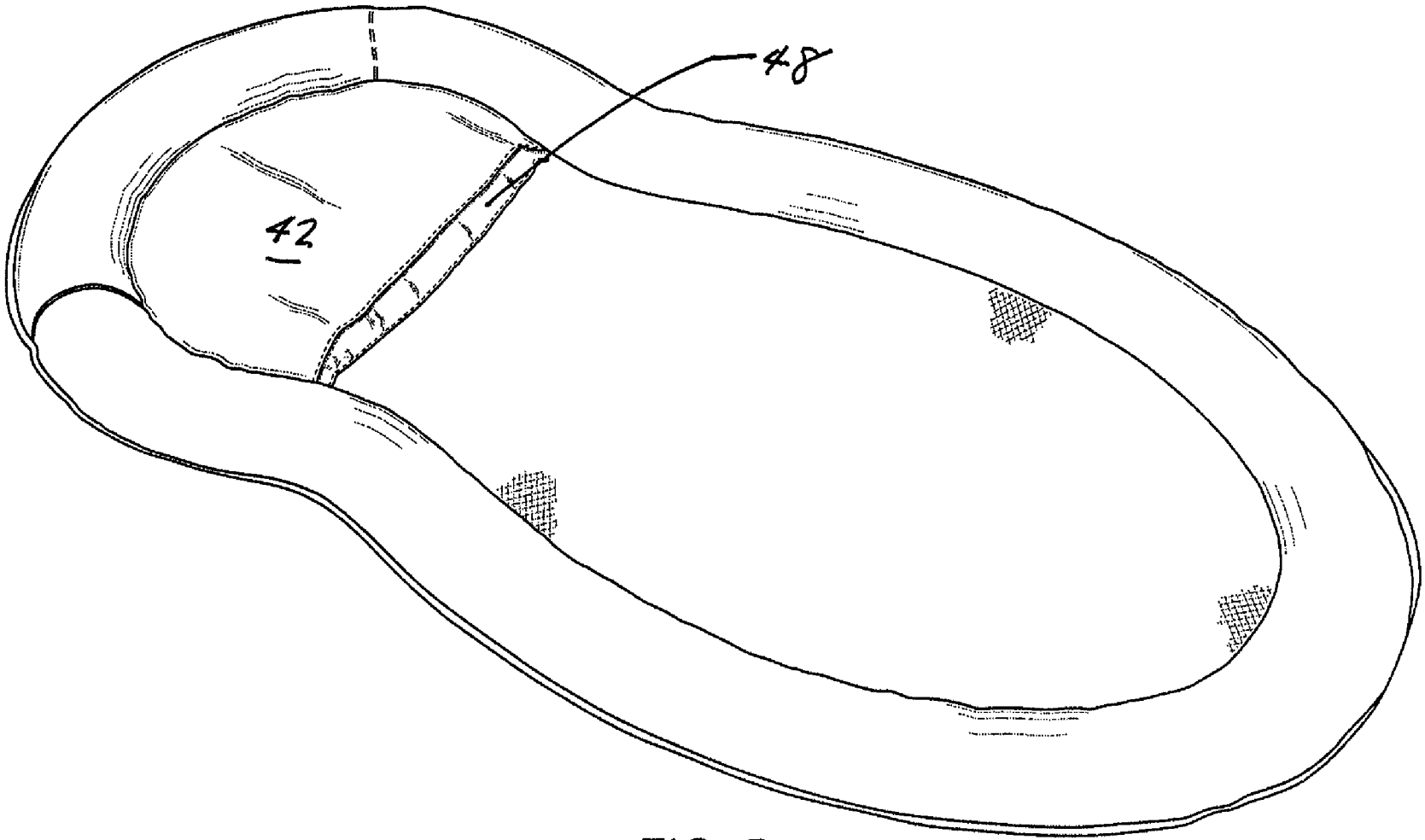
FIG. 5 is a perspective view of another embodiment of the instant invention, having an integral mesh pouch portion located on the top side of the mattress, over an inflatable, non-detachable pillow or headrest.

FIG. 5 depicts another embodiment of the instant invention, in which the pouch portion 42, preferably made of mesh material, is attached to mattress 10 on the same side as an inflatable, nondetachable pillow 48. Use of a mesh material for the pouch facilitates the draining of any water from the mattress after it is folded into the pouch, and also provides some elasticity to the pouch so that it may more easily receive the folded mattress. The deflated mattress may be folded into the pouch portion as in FIGS. 4*a*-4*d*, starting with the mattress face down. The deflated pillow 48 will then be on the outside of the pouch.

Returning to FIG. 1, perimeter portion 12 preferably comprises an inner bladder 27, which may be partly seen adjacent large valve 26, and an outer cover. The inner, inflatable bladder be made from any of a variety of materials, such as PVC, PVC(6P), HDPE, or any flexible weldable material. The outer cover may be made from any textile like Polyester, Nylon or any textile blend. This outer material may be a mesh material like that proposed for the pouch portion.

What is claimed is:

1. A foldable mattress having an integral carrying pouch, comprising:

a body portion made of foldable material;

an inflatable perimetral chamber portion made of foldable material, surrounding and attached to the body portion; and a pouch portion partially surrounded by said inflatable perimetral chamber portion and having an outer surrounding edge, said pouch portion being fixedly attached along a part of its edge to said body portion or said inflatable perimetral chamber portion, or both, to form a pocket between said pouch portion and said body portion or said inflatable perimetral chamber portion, or both, said pocket being adapted to receive said body portion and said inflatable perimetral chamber portion when said inflatable perimetral chamber portion is deflated and said body portion and inflatable perimetral chamber portion are folded into said pocket.

2. The mattress of claim 1, wherein the body portion is made of a mesh material.

3. The mattress of claim 1, wherein said pouch portion is made of a mesh material.

4. A foldable mattress having an integral carrying pouch, comprising:

a body portion made of foldable material;

an inflatable perimetral chamber portion made of foldable material, surrounding and attached to the body portion;

a pouch portion partially surrounded by said inflatable perimetral chamber portion and having an outer surrounding edge, said pouch portion being fixedly attached along a part of its edge to said body portion or said inflatable perimetral chamber portion, or both, to form a pocket between said pouch portion and said body portion or said inflatable perimetral chamber portion, or both, said pocket being adapted to receive said body portion and said inflatable perimetral chamber portion when said inflatable perimetral chamber portion is deflated and said body portion and inflatable perimetral chamber portion are folded into said pocket; and an inflatable pillow removably attached to said body portion, said inflatable pillow, when deflated, being capable of insertion into said pocket.

5. The mattress of claim 4 wherein the body portion is made of a mesh material.

* * * * *